US006497210B1

(12) United States Patent
Kattenhorn

(10) Patent No.: US 6,497,210 B1
(45) Date of Patent: Dec. 24, 2002

(54) FOOT ACTIVATED INDEPENDENT STANDING STARTER AID FOR HAND HELD INTERNAL COMBUSTION ENGINE MACHINES EMPLOYING A PULL CORD STARTER MECHANISM

(76) Inventor: Marion Richard Kattenhorn, 4592 W. Olive Ave., Fresno, CA (US) 93722

( * ) Notice: Subject to any disclaimer, the term of this patent is extended or adjusted under 35 U.S.C. 154(b) by 0 days.

(21) Appl. No.: 09/590,180

(22) Filed: Jun. 9, 2000

(51) Int. Cl.[7] ..... F02N 3/04
(52) U.S. Cl. ..... 123/185.4
(58) Field of Search ..... 123/185.2, 185.3, 123/185.4; 74/6

(56) References Cited

U.S. PATENT DOCUMENTS 4,397,274 A * 8/1983 Tarnedde ..... 123/185.4

* cited by examiner

*Primary Examiner*—Andrew M. Dolinar

(57) ABSTRACT

A independent free standing foot operated engine starter aid for hand held portable equipment having a hand operable starting cord. The assemblage comprising of: A base, a upright post fastened to the far right corner of the base with a directing pulley near the top of post, a hinged foot pedal to the opposit corner of base from post, a pulley fastened to the top of pedal's opposit end from the hinge, a flexible cable that one end fastened to top of the post, the free end of the cable goes down through the pedal pulley then up and over directing pulley on top of post then down and looped around handle of the engine pull cord. The portable equipment is held securely to the base while being started.

3 Claims, 4 Drawing Sheets

FOOT ACTIVATED INDEPENDENT STANDING STARTER AID FOR HAND HELD INTERNAL COMBUSTION ENGINE MACHINES EMPLOYING A PULL CORD STARTER MECHANISM

BACKGROUND—FIELD OF THE INVENTION

This invention relates to a foot activated starting aid specifically for hand held equipment employing a internal combustion with a pull cord starter mechanism.

BACKGROUND—DESCRIPTION OF PRIOR ART

Small, internal combustion engines have utilized the pull cord starting mechanism as a standard in the industry for a long time. These engines are commonly used in chain saws, string trimmers, leaf blowers. This action is fairly easy for an adult male without any physical handicap. Thus, any person with a physical limitation of upper body strength was precluded from starting their yard equipment or cutting their own wood with a chainsaw.

Other starting devices and aids have been tried and used to ease the abrupt back pulling physical force needed to start a hand held engine powered machine. One is a partial compression release valve that opens during the starting period of time. This method of easing the possible compression ignition kick back is troublesome because of possible compression loss during engine running causing power loss and also poor fuel-air ignition during starting operation on small engines.

Electric starters with self contained rechargeable batteries have been used but this method adds extra weight to the hand held machine and the unreliability of a fully charges battery leaves no other way to start the engine when a low charged battery is in the machine.

In search for other mechanical devices to aid the starting of portable hand held machines that are powered by a internal combustion engine that have an existing pull cord starting device, none was found.

Foot starting aids were researched for push-type and motorized lawnmowers including: U.S. Pat. No. 2,850,003 (1958) to Konle; U.S. Pat. No. 3,040,726 (1962) to Mayer; U.S. Pat. No. 3,174,471 (1965) to Welglage et al.; U.S. Pat. No. 3,381,677 (1968) to Hunter; U.S. Pat. No. 3,885,544 (1975) to Pfeiffer; U.S. Pat. No. 4,109,538 (1978) to Glenday ed al.; U.S. Pat. No. 4,257,367 (1981) to Fujikawa et al.; U.S. Pat. No. 4,397,274 (1983) to Tarnedde; U.S. Pat. No. 5,133,312 (1992) to Schede. They are not applicable to hand held, portable machines.

OBJECTS AND ADVANTAGES

The main object of the invention is to change the physical effort of using a person's hand, arm, shoulder and upper back muscles to using the sizable and vital muscles of the leg and foot for the main thrust of a person's effort on starting a portable hand held combustion engine machine. A person's activities of daily living such as walking, climbing, going to a flight of stairs is what is needed and used to operate this foot operated starting aid. It should be noted here that these activities are also necessary to use the machines for their said purpose.

Another advantage of the invention is built into the design as the "means of holding" the equipment in place while the engine is being started. Due to the small engine's possible compression-ignition kick-back, it can cause loss of standing posture balance to the person attempting to start the machine with its pull cord starter only. This foot powered starting aid provides a positive controlled fast pull to the existing pull cord starter mechanism of small engines with out the possible physical harm done to an operator.

Also relating another advantage to the "means of holding" the independent foot starting aid provides is the ability of the machine operator to use both hands to adjust the choke and carburetor.

Further relating to the advantage the "means of holding" the independent foot starting aid provides is the conversion of physical effort that is exerted by the use of pulling the existing starting pull cord by hand, possibly many times.

An object of the invention is to provide a starting aid that can be fabricated from commonly available materials that are low in cost and use existing methods of fabrication.

A further object of the invention is the provision of a piece of equipment that requires no further lubrication or extensive maintenance.

An advantage to the invention with foot power depressing the foot pedal from the upper end of the foot pedal's arc swing, to the base, causes a multiplied travel of one to two (1:2) of the down travel of the pulley on the foot pedal in relation to the pull travel of the handle on the free end of the engine starter pull cord. For every one inch of down travel of the pulley on the foot pedal there is a 2 inch pull travel transmitted by the cable to the handle on the free end of the engine starter pull cord.

Also inherent to the advantage of using a foot pedal for power gives the action of depressing the pedal with a person's foot and in turn causes the engine to rotate twice as fast or maybe faster than the backward pull of the starter pull cord with an exerted effort a person's hand, arm, shoulder and upper back muscles during the starting operation of the engine.

Another advantage of the invention specifically gives 4 advantageous benefits to rotating a two stroke cycle internal combustion engine faster, during the starting phase of starting a internal combustion engine with this invention. They are: A) better carburation, B) higher compression, C) better ignition, D) less chance of "compression ignition kickback".

DESCRIPTION OF PREFERRED EMBODIMENTS

As a new article of manufacture, a independent and free standing foot operated engine starter assemblage for hand held portable equipment having a internal combustion engine of the type equipped with a hand operated pull cord starter is provided.

Figure 1A:
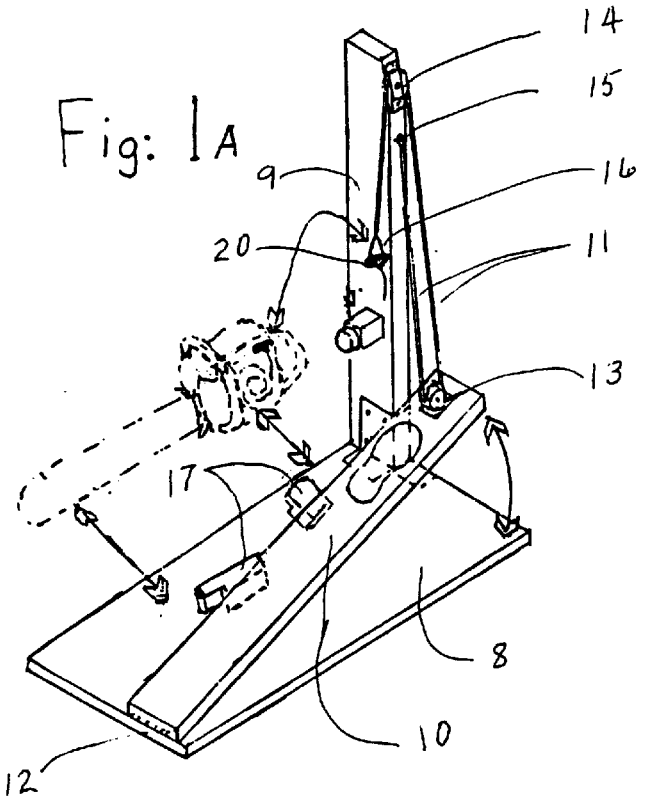
FIG. 1A shows a foot starter aid adapted for use with a chainsaw.
Figure 1B:
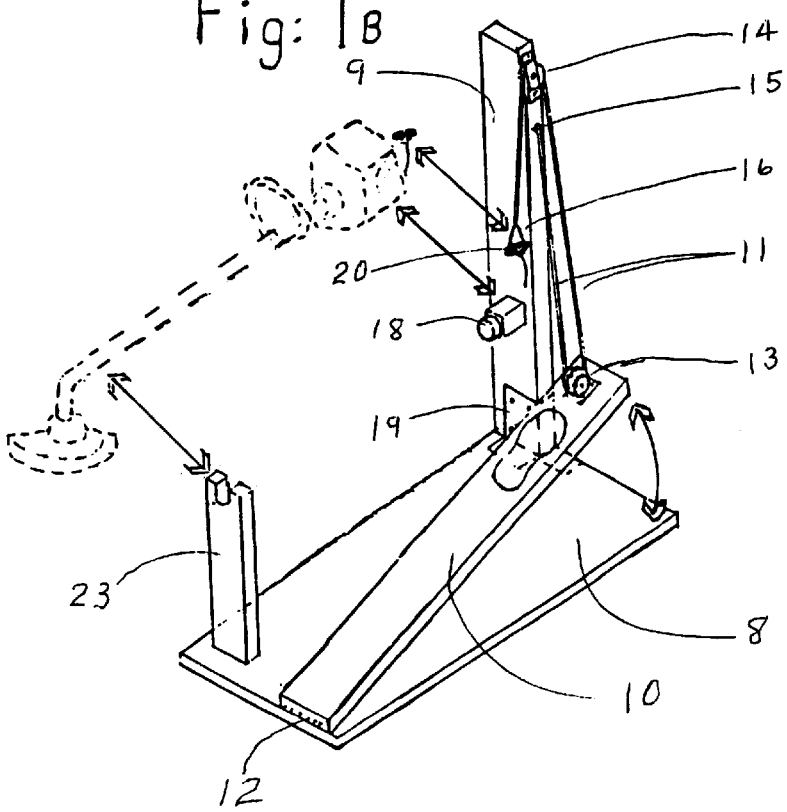
FIG. 1B shows a foot starter aid adapted for use with a string trimmer.
Figure 2A:
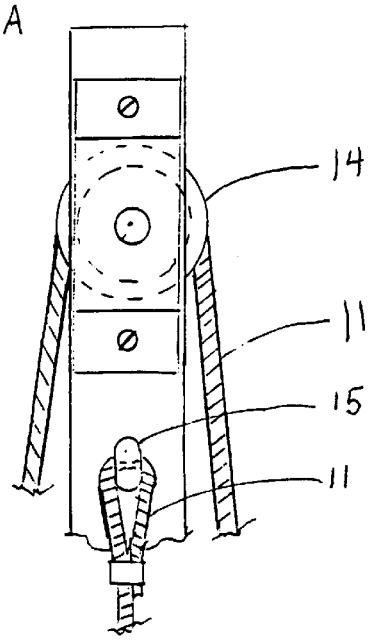
FIG. 2A is a side view of the top of an upright post with directing pulley, cable and eye screw in the foot starter aid.
Figure 2B:
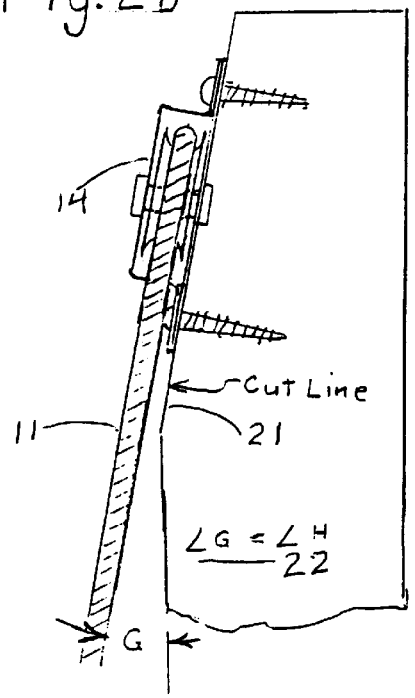
FIG. 2B is an end view of the upright post showing an angle cut line for a pulley seat.
Figure 4A:
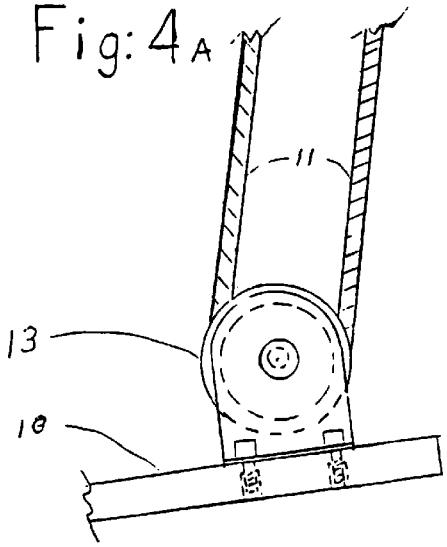
FIG. 4A is a side view of the end of the foot pedal with pulley and cable.
Figure 4B:
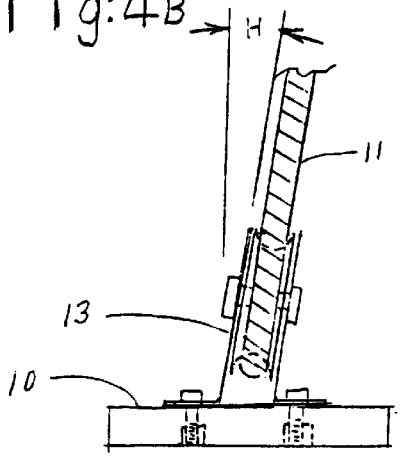
FIG. 4B is an end view of foot pedal showing tilt angle of pulley.
Figure 3:
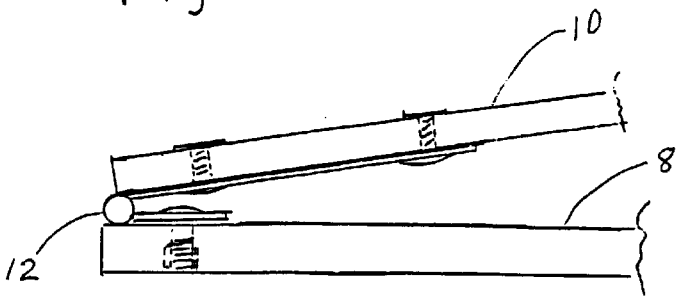
FIG. 3 shows a portion of the foot starter aid including the end of a platform base, hinge and attaching bolts, and foot pedal.
Figure 5:
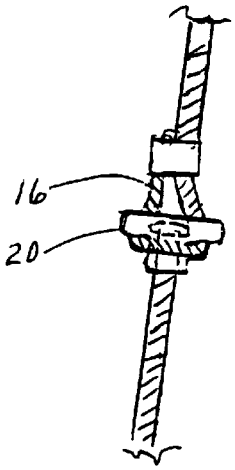
FIG. 5 shows a cable loop around an engine pull cord handle.
Figure 6A:
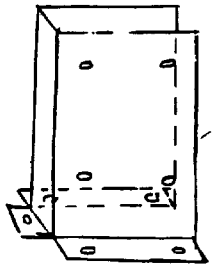
FIG. 6A shows a flange bracket.
Figure 6B:
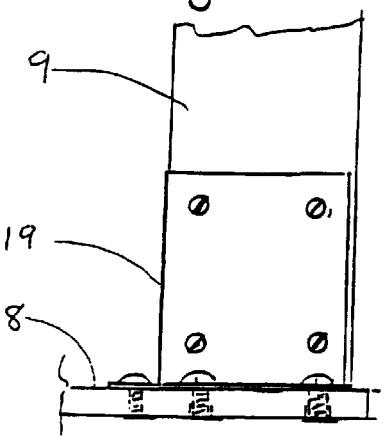
FIG. 6B shows the flange bracket bolted to the base and upright post.
Figure 7A:
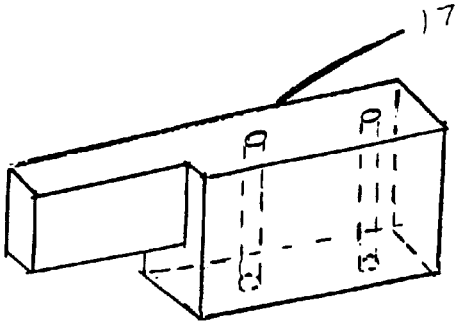
FIGS. 7A and 7B show holding blocks for a chainsaw.
Figure 7B:
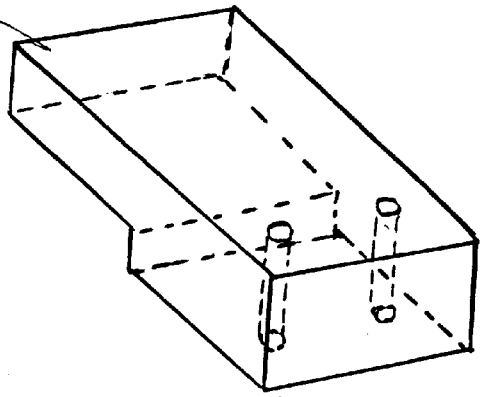
Figure 7C:
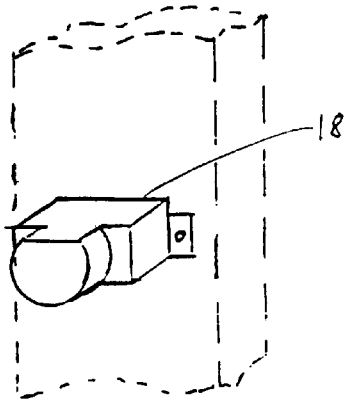
FIGS. 7C and 7D show holding brackets for a string trimmer.
Figure 7D:
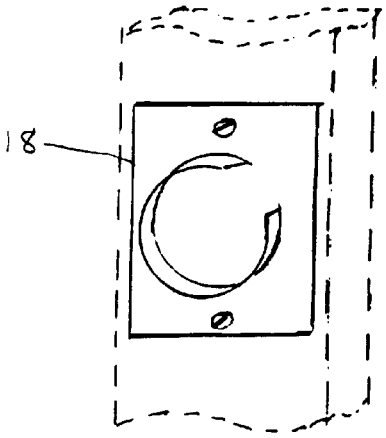

Referring first to FIG. 1A and FIG. 1B, there is illustrated a foot starter assemblage for starting a handheld machine that incorporates a internal combustion engine of the type that uses a hand operated pull cord starting device. This foot starter assemblage as shown in FIGS. 1A and 1B, includes a base 8, and upright support port 9 secured to the base 8 and having a pulley 14 at the top, a pivotable foot pedal board 10 attached by hinge 12 to the base 8, a single cable pulley 13 secured to the opposite end of the pedal board 10 from the hinge 12, a flexible cable 11 with one end fastened to eyescrew 15, near the top of the upright post 9 that then passes down and through the pulley 13 of the foot pedal 10, then extends up and over pulley 14, then to and with a small loop 16 at the other end of the cable 11 which goes around the handle 20 that is on the free end of the said equipment engine starter pull cord. A "means of holding" including blocks 17 or brackets 18 maintain the hand held portable engine equipment stable in place to the base 8 and the upright post 9 while the engine is being started. Base 8 provides a foundation platform for the foot starter assemblage. Upright support post 9 is secured with a flange mount 19 to the corner of base 8. Loop 16 on the free end of flexible cable 11 is coupled to handle 20 on the end of the starting pull cord of the hand held machine to start the engine. The "Cut line" 21 in FIG. 2B aligns the angle G of pulley 14 with tilt angle H of pulley 13 as shown in FIG. 4B. The foot starter aid adapted for use with a string trimmer includes a shaft rest 23 for the string trimmer shaft to be placed on for starting.

A foot power down push action on foot pedal 10 from up static position of foot pedal 10 causes a down pull of the flexible cable 11 that is looped around the engine's starting pull cord handle 20 which now gives the engine starting action. After the engine starts the hand held machine is easily and safely removed from "means of holding" 14, 18 for operation.

CONCLUSION

This foot starter invention was conceived as a alternative to the using of my hands, arms, shoulder and back muscles pulling a starter pull cord which was inflecting pain on my body. The thought of using my leg muscles seemed more practical at my age given that arthritis was beginning to have a painful effect on me. The downward push of my foot converted to a up pull on a portable hand held machine starter pull cord, by means of foot pedal with a moving pulley attached to it and a cable that one end was held stationary, the free end threaded down through the moving pulley then up over a stationary directing pulley and down to the starter pull cord of the machine that is held in place would result in a fast, strong up pull of the machine starter pull cord. I hinged the foot pedal to the base board and to my surprise the engine started the second down push I gave the pedal. There was no pain to my body, the engine started fast, easy and safely.

What is claimed is:

1. A foot operated starting mechanism for a hand held machine having an internal combustion engine with a starter pull cord, comprising:

A platform base;

An upright support post mounted on the platform base and having a pulley;

A foot pedal board pivotably attached to the platform base and having a pulley;

A flexible cable attached to the support post and attachable to said starter pull cord so as to be guided by said pulleys; and, Means for holding said hand held machine in position to be started.

2. A foot operated starting mechanism according to claim 1, wherein the starting pull cord is stopped by said pulley reaching the platform base.

3. A method of starting a hand held machine having an internal combustion engine with a starter pull cord comprising:

supporting said hand held machine in position to be started with a free standing starting mechanism having a foot pedal;

attaching said starter pull cord to the free standing foot operated starting mechanism; and actuating said foot pedal to start the engine.

* * * * *